US005903948A

United States Patent [19]

Williams et al.

[11] Patent Number: 5,903,948

[45] Date of Patent: May 18, 1999

[54] MOPPING AND BRUSHING APPARATUS

[75] Inventors: Todd A. Williams, Aliso Viejo; Richard A. Williams, Dana Point, both of Calif.

[73] Assignee: SC Johnson Commercial Market Inc., Sturtevant, Wis.

[21] Appl. No.: 08/901,572

[22] Filed: Jul. 28, 1997

[51] Int. Cl.[6] ..... A47L 13/12

[52] U.S. Cl. ..... 15/115; 15/229.2

[58] Field of Search ..... 15/114, 115, 116.1, 15/116.2, 229.1, 229.2, 228, 118

[56] References Cited

U.S. PATENT DOCUMENTS

| | | | |
|---|---|---|---|
| D. 358,487 | 5/1995 | Kneesch et al. . | |
| 377,955 | 2/1888 | O'Blenus . | |
| 399,223 | 3/1889 | Varney . | |
| 625,628 | 5/1899 | Wray . | |
| 702,998 | 6/1902 | Randolph . | |
| 729,581 | 6/1903 | Held . | |
| 732,743 | 7/1903 | Held . | |
| 798,532 | 8/1905 | Sanders . | |
| 937,007 | 10/1909 | McLaughlin . | |
| 981,756 | 1/1911 | Glancey . | |
| 1,067,570 | 7/1913 | Ziegler . | |
| 1,171,768 | 2/1916 | Browning . | |
| 1,221,606 | 4/1917 | Sadler . | |
| 1,331,477 | 2/1920 | Albin . | |
| 1,563,829 | 12/1925 | Brown | 15/114 |
| 1,589,253 | 6/1926 | Smiechewicz . | |
| 1,748,202 | 2/1930 | Bloomfield . | |
| 1,760,614 | 5/1930 | Weintraub | 15/115 |
| 2,133,148 | 10/1938 | Paul . | |
| 2,518,765 | 8/1950 | Ecker . | |
| 2,637,867 | 5/1953 | Kalinowski | 15/115 |
| 2,641,787 | 6/1953 | Vosbikian et al. . | |
| 2,678,458 | 5/1954 | Vosbikian et al. . | |
| 2,683,886 | 7/1954 | Neumann . | |
| 2,701,888 | 2/1955 | Vosbikian et al. . | |
| 3,157,901 | 11/1964 | Murphy . | |
| 3,167,798 | 2/1965 | Dryden . | |
| 3,906,580 | 9/1975 | Smith et al. . | |
| 3,964,121 | 6/1976 | Kim . | |
| 4,802,782 | 2/1989 | Scalf . | |
| 5,435,852 | 7/1995 | Robinson . | |
| 5,522,110 | 6/1996 | Borofsky . | |
| 5,584,091 | 12/1996 | Borofsky . | |

FOREIGN PATENT DOCUMENTS

| | | | |
|---|---|---|---|
| 737140 | 6/1966 | Canada . | |
| 1309326 | 10/1962 | France . | |
| 40362 | 11/1924 | Norway | 15/115 |
| 155174 | 5/1920 | United Kingdom | 15/116.1 |

OTHER PUBLICATIONS

"Edge Hog—An Advanced Cleaning Tool" by Emsco Group, Girard, Pa.

*Primary Examiner*—Mark Spisich
*Assistant Examiner*—Andrew Aldag
*Attorney, Agent, or Firm*—William W. Haefliger

[57] ABSTRACT

An apparatus for scrubbing and mopping a surface, comprising in combination, a scrub brush, including a supporting block and bristles carried by the block, to project toward the surface for scrubbing that surface; the first structure for attaching an elongated handle to the block to extend in a first direction from the block; and second structure for attaching a mop to the block, with mop strands extending in generally parallel relation with that surface and in mopping contact therewith, as the bristles project to simultaneously engage that surface, for simultaneous mopping and scrubbing of that surface, as the handle extends at an angle to the surface to displace the block, bristles and mop parallel to the surface.

14 Claims, 3 Drawing Sheets

MOPPING AND BRUSHING APPARATUS

BACKGROUND OF THE INVENTION

This invention relates generally to treatment such as cleaning of surfaces, and more particularly, to improvements in apparatus for scrubbing and mopping of surfaces by force application, as via an elongated handle.

Many surfaces to be cleaned contain interstices, cracks or crevices, in which dirt particles become embedded, or otherwise build up. Examples are cracks between tiles forming tiled surfaces, cracks and crevices in marble, clay, concrete, or synthetic material flooring, and surface interstices in many different types of floors. It is extremely efficient to remove such embedded or built up dirt particles using conventional mopping apparatus and/or procedure. It becomes necessary to scrub such surfaces, using a brush or brushes having bristles that can reach and remove the embedded soil or dirt particles.

In the past, it was known to provide for scrubbing and mopping of floor surfaces, using elongated handled equipment; however, such equipment lacked the unusually advantageous improvements in structure, functions and results, as are now enabled and produced by the present invention, and meeting needs for improved and more effective use and operation, as will appear.

SUMMARY OF THE INVENTION

It is a major object of the invention to provide improved method and apparatus meeting the above needs. Basically, the apparatus of the invention includes the following:

a) a scrub brush, including a supporting block and bristles carried by the block, to project toward a surface to be cleaned, for scrubbing that surface, b) first means for attaching an elongated handle to the block to extend in a first direction from the block, c) and second means for attaching a mop to the block to extend in generally parallel relation with that surface and in mopping contact therewith as the bristles simultaneously engage that surface, for mopping and scrubbing the surface simultaneously as the handle extends at an angle to the surface to displace the block, bristles and mop parallel to the surface.

It is another object of the invention to provide such a device wherein the mop has a head easily attached to the block at a first location or locations spaced from the first attachment means, the block typically being wooden and extending laterally to provide support and stability for both the mop and the bristles. Typically, the mop head has screw thread attachment to the block to facilitate such quick attachment.

It is another object to provide a device, as referred to, wherein the handle is attached to the block at a second location, typically spaced from the location or locations of mop head attachment to the block.

It is a further object to provide a device, as referred to, wherein the block has multiple sides, the first location is at one of the sides and the second location is at another of the sides.

It is another object to provide a device, as referred to, wherein the block is wooden, has an underside from which bristles extend downwardly, to provide for bristle scrubbing of floor surfaces; and the block has a forward side to which the mop head is attached, generally below the top level surface of the block. The handle preferably attaches to the block via that upper surface, and directly rearwardly of the mop head attachment to the block, whereby force from the handle is distributed to the bristles via the laterally extending block and directly transmitted to the mop at a location medially of the brush, for optimum stabilized force transmission to both the bristles and the mop, enabling very effective scrubbing and mopping action, simultaneously.

A further object is to provide said screw thread fastener attachment to include an externally threaded bolt anchored to the mop head, and an internally threaded insert anchored to the block and receiving the bolt. A flange may be located on the insert and located forwardly of the block, and tangs integral with the flange and penetrating the block, to prevent rotation of the insert in response to rotatable tightening of the bolt relative to the insert.

Yet another object is to provide differential length bristles on the block, and related in position to the mop to ensure removal of dirt and soils from cracks and crevices in flooring.

The apparatus of the present invention can be used for cleaning floors with tough dirt, stuck litter and oil stains. The cleaning apparatus is especially suitable for cleaning industrial floors, such as the floors of restaurants' kitchens, which usually are made of clay or concrete, with rough and porous surfaces to protect slipping. Advantageously, the cleaning apparatus of the present invention can perform surface cleaning and deck brushing functions simultaneously and conveniently by providing a mop and brush being removably and adjustably installed in a single assembly.

These and other objects and advantages of the invention, as well as the details of an illustrative embodiment, will be more fully understood from the following specification and drawings, in which:

DRAWING DESCRIPTION

DETAILED DESCRIPTION

Figure 1:
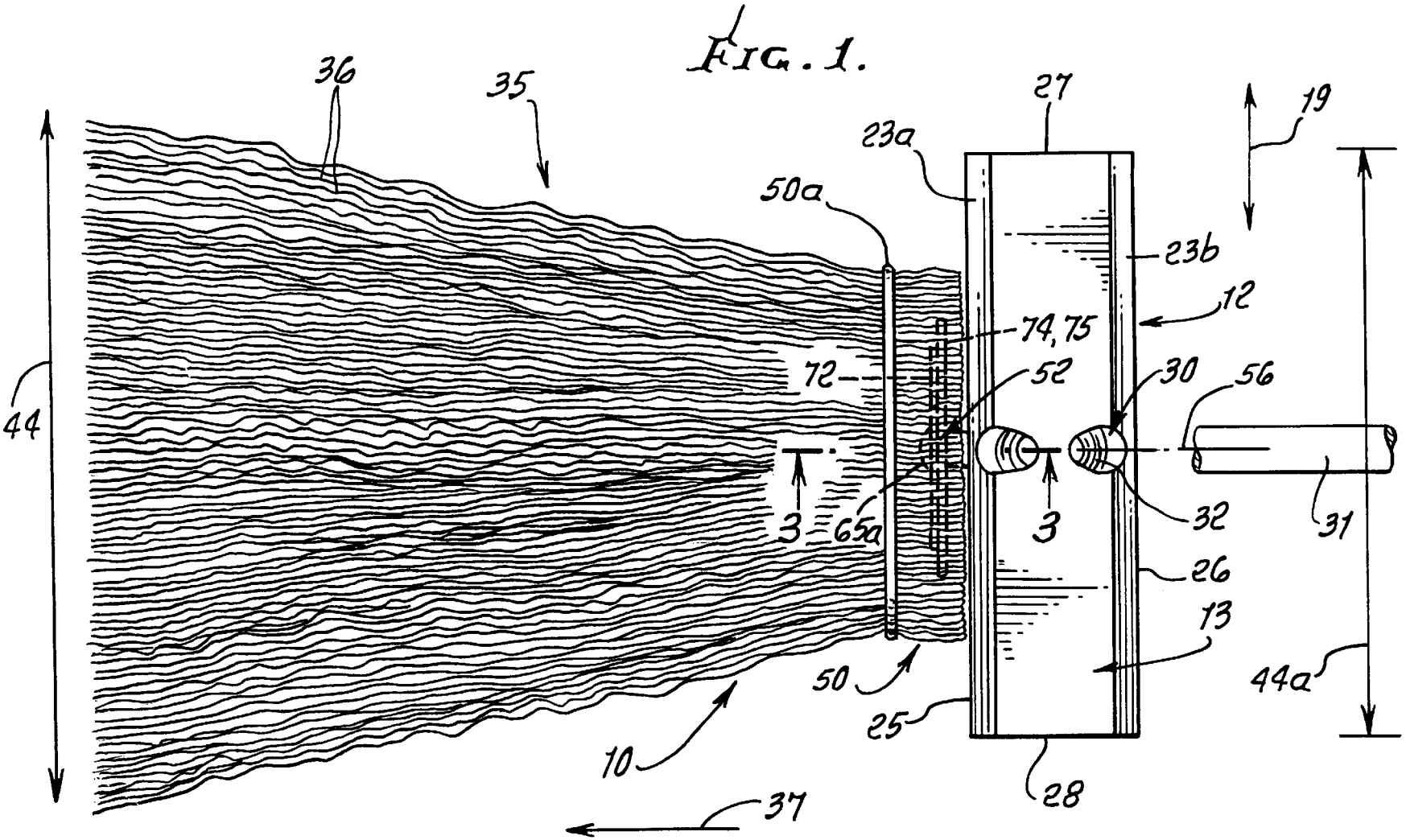
FIG. 1 is a plan view of apparatus embodying the invention.

In FIGS. 1–4, a preferred form of the apparatus 10, for scrubbing and mopping a surface 11, such as a floor, is shown in operating position. The basic elements comprise a scrub brush 12 that includes a block 13, and bristles 14 having their upper ends 14*a* carried by the block. The bristles project, as for example, downwardly as shown, toward the surface 11 in position for contacting that surface at bristle lower ends 14*b*.

Water and/or chemical cleaner may be applied to that surface, as at 15 and 16, to aid in bristle dislodgment of soils, grit and dirt particles from interstices and cracks in that surface. These are indicated at 17, and may take various forms.

Figure 2:
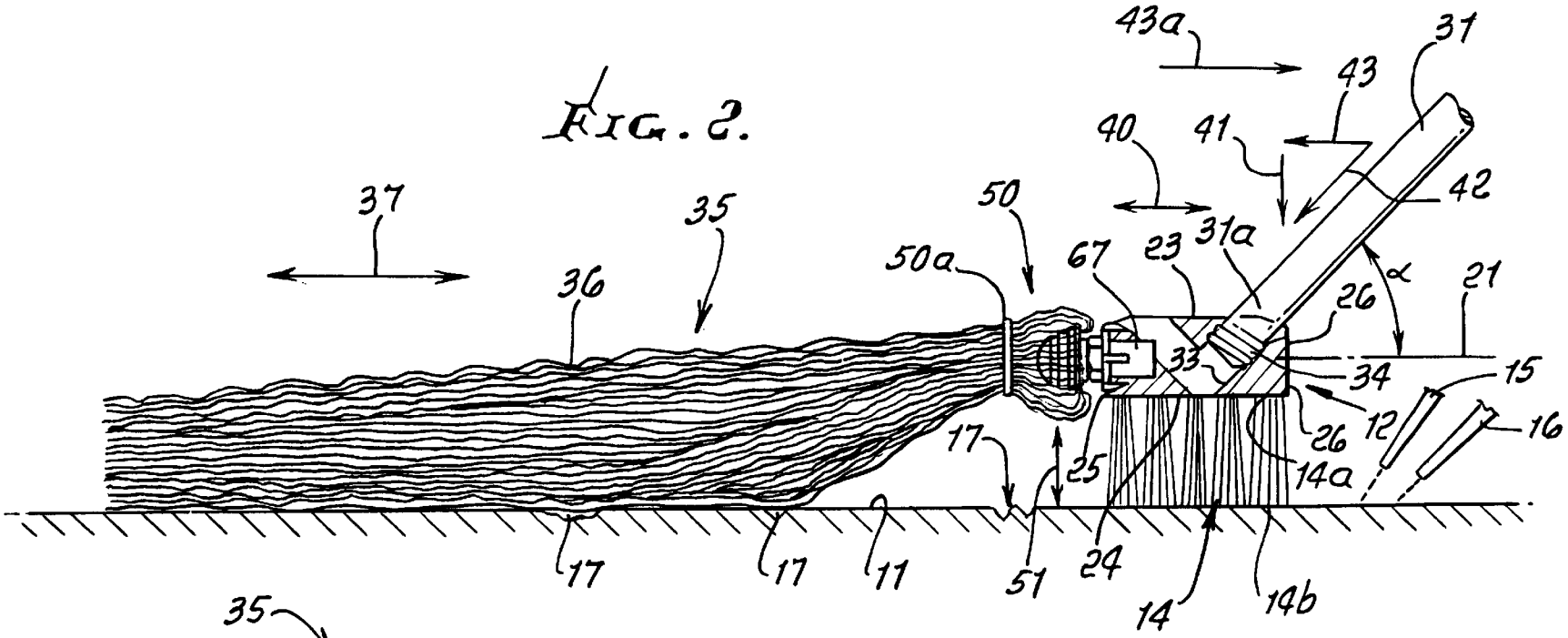
FIG. 2 is a side elevational view of the FIG. 1 apparatus.

Block 13 is typically laterally elongated in directions 19, as seen in FIG. 1, and relative to a longitudinal axis 21, seen in FIG. 2. Block 13 may consist of wood, or other material, and has an upper side 23, a bottom side 24 from which the bristles project, a front side 25, a rear side 26, and opposite ends 27 and 28. Sides 25 and 26 may be perpendicular, or substantially perpendicular to axis 21, and to the planes of upper and lower sides 23 and 24. Surface 23 may be beveled as at 23*a* and 23*b*.

First means is provided, as at 30, for attaching an elongated handle 31 to the block, to extend in a first direction from the block. Such first means may, for example, include female screw threading at 32 formed in a recess 33 sunk downwardly and forwardly at the rear of the block top side 23, mid-way between opposite ends 27 and 28. The lower end portion 31*a* of the handle may form or carry complementary male threading at 34 to rotatably attach to threading 32, whereby the handle is firmly connected to the block, to extend upwardly and rearwardly at an angle α relative to and above axis 21.

Another basic element of the apparatus comprises a mop seen at 35 and having flaccid strands 36 shown in FIG. 1, as extending forwardly of the front side 25 of the block in direction 37. Second means is provided for attaching the mop to the block, whereby the strands 36 extend in generally parallel relation with surface 11, the lower strands freely engaging that surface, for mopping same when the block 13 is moved frontwardly and rearwardly in directions 40, as seen in FIG. 2, and simultaneously with bristle scrubbing engagement with the surface. Accordingly, the downward component 41 of handle force 42 exerted on block 13 acts to push the bristles downwardly into and over the crevices, cracks and interstices 17 at the same time as the forward component 43 of handle force pushes or displaces the flaccid mop strands 36 forwardly, and subsequently the rearward component 43*a* of handle force pulls the strands 36 rearwardly over the interstices and cracks 17, to displace liquid into and from the crevices and cracks 17, carrying away or removing the bristle loosened soils and dirt. Fresh, aqueous liquid and/or cleaner is simultaneously mopped into the crevices or cracks to aid in loosening remanent soils and dirt, as the bristles are subsequently displaced forwardly again, with downward force component applicable at 41 to further or complete the soils and dirt loosening in the cracks and crevices filled with mopped liquid. The downwardly yieldable resilient spring aspect of the relatively stiff bristles assists in their penetration of the cracks and crevices under the influence of the downward force component 41.

Note that the mop 35 has flaccid strand lateral dimension 44 approximating the lateral dimension 44*a* of the brush block, and bristles, whereby the simultaneous mopping and scrubbing effect, as described, is attained throughout the approximately equal lateral extents 44 and 44*a*.

Further, preferred attachment of the mop head 50 to the front side 25 of the block 13, above the level of the floor (see dimension 51 in FIG. 2) attains maximum proximity of the main extent of the mop to the floor 11, to enhance mopping and scrubbing effect, as described, while also facilitating direct, forward and rearward force transmission from the block to the mop head 50 and to the mop 35, for ease of required force transmission (push and pull) to the handle from the user's arm.

The mop head 50 consists of a tightly gathered bundle of mop strand portions, which may be clamped together by a metallic clamp or wire, as at 50*a*. The tight bundle also provides a semi-rigid support and holder for attachment of the mop head to the front side 25 of the block 13, with the laterally elongated head 50 in close parallel relation to the laterally elongated block front side or side wall 25. A mutually supporting relation of the head and block is thereby achieved.

Preferably, a screw threaded fastener attachment of the mop head 50 to the block is provided at a second location 52 forwardly spaced from the first means 30 attachment of the handle to the block. This assures that the downward component of force 41 will be substantially completely transmitted to the bristles, and not to the mop itself, for maximum scrubbing effect. Spacing 51 assures this. Note in this regard that the second location 52 attachment and the attachment at 30 define an upright plane that bisects the block. See plane 56 in FIG. 1. Plane 56 also bisects the bristles, the mop head 50 and the mop 35 for optimum stability during use.

Figure 3:
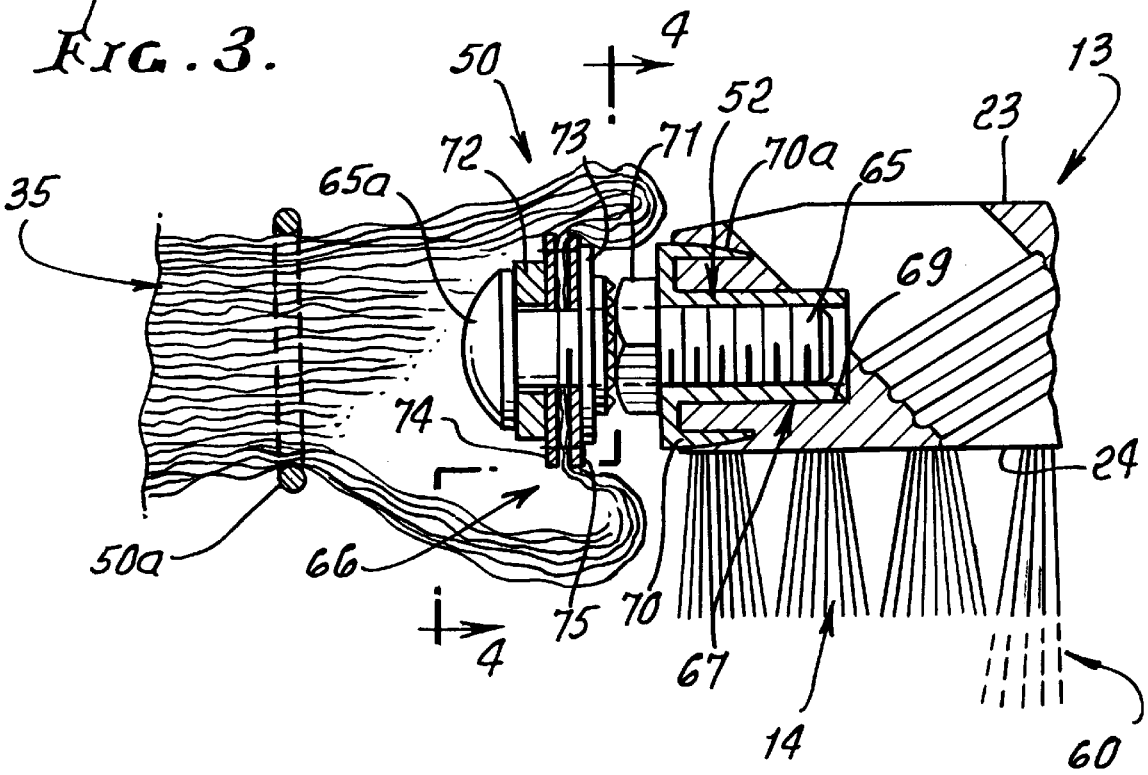
FIG. 3 is an enlarged section taken on lines 3—3 of FIG. 1.
Figure 4:
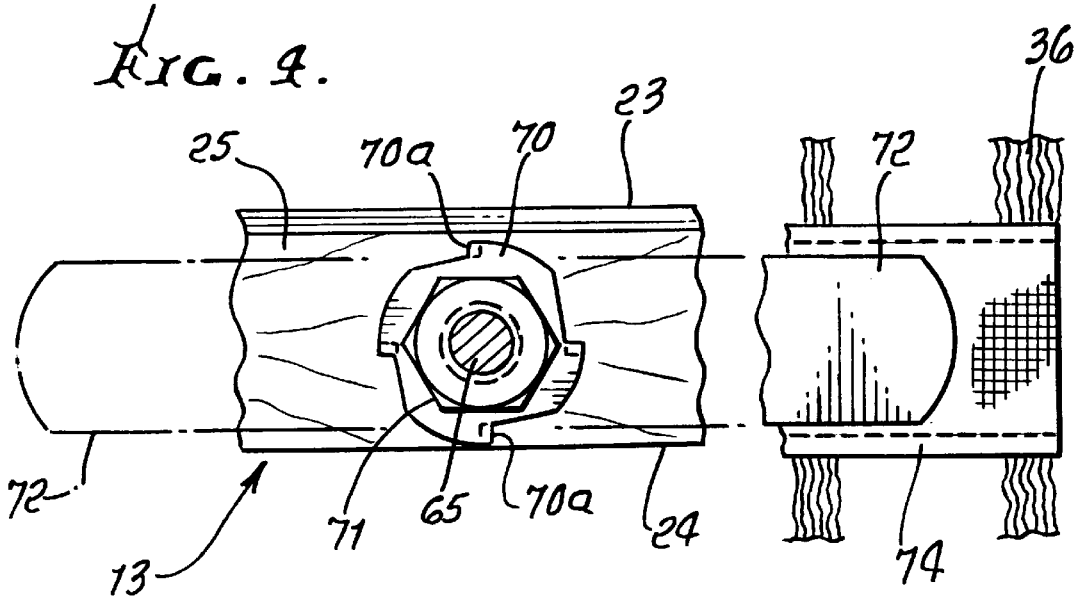
FIG. 4 is a section taken on lines 4—4 of FIG. 3.

The screw thread attachment at location 52 may advantageously take the form as shown in FIG. 3. It includes a screw-threaded bolt 65 anchored at 66 in the mop head, and projecting rearwardly from the mop head. It is rotatably screwed into a female threaded insert 67 in a recess 69 sunk in the block. An annular flange 70 on the insert fits against block front side 25, and tangs 70*a* on the flange penetrate the block to anchor the insert in position.

A nut 71 on the bolt clamps against flange 70. A laterally elongated back-up bar 72, a washer 73, and mop strand clamping members 74 and 75 are all assembled on the bolt shank and clamped between spacer 76 and bolt head 65*a*. This assembly provides a stable support for the mop head as the fastener connection is made up, as by rotation of the mop and its head relative to the block, about axis 21. This in turn provides a stop that enables repeatable, forcible connection and disconnection of the mop head to the block, without gouging away of the wooden block by direct engagement of the rotary connection with such wood. Such gouging would alter the completed make up rotary positioning of the mop head relative to the block, i.e., a means is provided to enable repeatable positioning of the mop head (as when mops are changed, etc.) in parallel to the block, in response to rotary tightening of the screw thread attachment.

The lateral row of bristles furthest from the mop may be elongated, as indicated at 60 in FIG. 3, to provide enhanced scrubbing of cracks and crevices in the floor surface.

Figure 5:
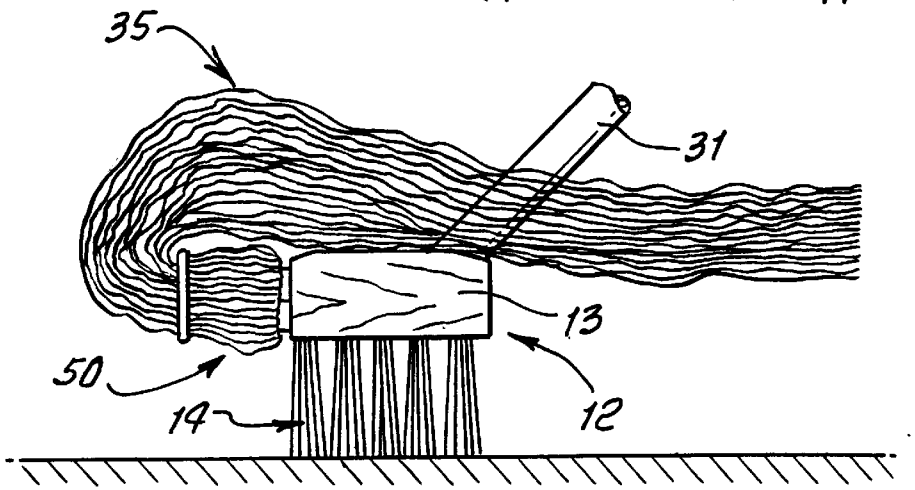
FIG. 5 is an elevation like FIG. 2 but showing an alternate mode of use.

FIG. 5 shows mop strands folded back over the brush, during scrubbing without mopping.

We claim:

1. Apparatus for scrubbing and mopping a surface, comprising in combination:

a) a scrub brush, including a supporting block and bristles carried by the block, to project toward the surface for scrubbing that surface, b) first means for attaching an elongated handle to the block to extend in a first direction from the block, c) a mop with strands and second means for attaching said mop to the block with the mop strands extending in generally parallel relation with that surface and in mopping contact therewith as the bristles project to simultaneously engage that surface, for simultaneous mopping and scrubbing of that surface, as the handle extends at an angle to the surface to display the block bristles and mop parallel to the floor surface, d) said second means being at a first location spaced from said first means, e) said first means being at a second location, to he spaced from said mop, f) said block having multiple sides, said first location being at one of said sides and said second location being at another of said sides, g) said second means including male and female attachment members projecting in a direction at said block one side that is opposite the general direction from which said handle extends from said block another side.

2. The combination of claim 1 including said mop having a head attached to the block at said first location.

3. The combination of claim 2 wherein said second location bisects said block.

4. The combination of claim 2 wherein said head has a screw thread fastener attachment that secures said head to the block at said first location.

5. The combination of claim 4 wherein said second location and said screw thread fastener attachment define a plane which bisects said block.

6. The combination of claim 5 including means to position the mop head in substantially the same configuration with respect to the block during rotary tightening of said screw thread attachment.

7. The combination of claim 2 wherein said bristles include rows of bristles, at least one bristle row having length greater than bristles in other rows.

8. The combination of claim 1 wherein said first means includes structure to removably and rigidly attach the handle to the block at said other side.

9. The combination of claim 8 wherein said second means includes other structure to removably and rigidly attach the mop to the block at said one side.

10. The combination of claim 9 wherein said block another side faces relatively upwardly, and said block one side faces in a direction that is generally perpendicular to said block another side and opposite the general direction from which said handle extends from said block another side.

11. Apparatus for scrubbing and mopping a surface, comprising in combination:

a) a scrub brush, including a supporting block and bristles carried by the block to project toward the surface for scrubbing that surface, b) first means for attaching an elongated handle to the block to extend in a first direction from the block, c) a mop with strands and second means for attaching said mop to the block with the mop strands extending in generally parallel relation with that surface and in mopping contact therewith as the bristles project to simultaneously engage that surface, for simultaneous mopping and scrubbing of that surface, as the handle extends at an angle to the surface to displace the block, bristles and mop parallel to the floor surface, d) said mop having a head attached to the block at a first location spaced from said first means, e) said second means comprising, an externally threaded bolt anchored to said mop head, and an internally threaded insert anchored to the block for receiving said bolt.

12. The combination of claim 11 including a flange on the insert of the block, and tangs integral with the flange and penetrating the block, to prevent rotation of the insert in response to rotatable tightening of the bolt relative to the insert.

13. Apparatus for scrubbing and mopping a surface, comprising in combination a) a scrub brush, including a supporting block and bristles carried by the block to project toward the surface for scrubbing that surface, b) first means for attaching an elongated handle to the block to extend in a first direction from the block, c) a mop with strands and second means for attaching said mop to the block with the mop strands extending in generally parallel relation with that surface and in mopping contact therewith as the bristles project to simultaneously engage that surface, for simultaneous mopping and scrubbing of that surface, as the handle extends at an angle to the surface to displace the block, bristles and mop parallel to the floor surface, d) said mop having a head attached to the block at a first location spaced from said first means, e) said head having a screw thread fastener attachment securing said mop to the block at said first location, f) and including said handle attached to the block at a second location, spaced from said mop head, said second location and said screw thread fastener attachment defining a plane which bisects said block, g) and wherein said block has multiple sides, said first location being at one of said sides and said second location being at another of said sides.

14. A combined brush and mop structure, comprising in combination:

a) a block having multiple sides, b) a handle attached to the block at one of said sides and a scrubbing means extending from a second of said sides, c) a mop having a head attached to the block at a third of said sides, and wherein a screw threaded attachment is provided to attach the head to the block, said screw threaded attachment including an externally threaded bolt element and an internally threaded insert element one element anchored to the block and the other element anchored to the mop head.

* * * * *